US006436181B1

(12) United States Patent
Gillberg et al.

(10) Patent No.: US 6,436,181 B1
(45) Date of Patent: Aug. 20, 2002

(54) SIZING COMPOSITION AND A METHOD OF SIZING

(75) Inventors: Lars Ingemar Gillberg, Lund (SE); Josep Lluis Bisbal Tudela, Sant Cugat del Vallés (ES)

(73) Assignee: Kemira Kemi AB, Helsingborg (SE)

( * ) Notice: Subject to any disclaimer, the term of this patent is extended or adjusted under 35 U.S.C. 154(b) by 103 days.

(21) Appl. No.: 09/689,591

(22) Filed: Oct. 13, 2000

Related U.S. Application Data

(63) Continuation of application No. PCT/SE99/00593, filed on Apr. 13, 1999.

(30) Foreign Application Priority Data

Apr. 14, 1998 (SE) ..... 9801276

(51) Int. Cl.[7] ..... D21H 17/62; D21H 17/66; C08L 93/04; C09D 193/04

(52) U.S. Cl. ..... 106/218; 106/241; 162/180; 162/181.5

(58) Field of Search ..... 106/218, 241; 162/180, 181.5

(56) References Cited

U.S. PATENT DOCUMENTS

| | | | | |
|---|---|---|---|---|
| 3,966,654 A | | 6/1976 | Aldrich | |
| 4,199,369 A | | 4/1980 | Hughes et al. | |
| 4,522,686 A | | 6/1985 | Dumas | |
| 5,512,135 A | * | 4/1996 | Carre et al. | 162/175 |
| 5,627,224 A | * | 5/1997 | Lyrmalm et al. | 524/52 |

FOREIGN PATENT DOCUMENTS

| | | | |
|---|---|---|---|
| DE | 4103169 | A1 | 7/1992 |
| EP | 0062015 | A1 | 10/1982 |
| EP | 0074544 | B1 | 3/1983 |
| EP | 0200002 | B1 | 12/1986 |
| EP | 0275851 | A1 | 7/1988 |
| EP | 0292975 | A1 | 11/1988 |
| EP | 0418191 | A1 | 3/1991 |
| EP | 0693589 | B1 | 1/1996 |
| EP | 0750069 | A1 | 12/1996 |
| ES | 9800750 | | 2/1990 |
| GB | 2159183 | A | 11/1985 |
| WO | WO9401619 | A1 | 1/1994 |
| WO | WO9635841 | A1 | 11/1996 |

OTHER PUBLICATIONS

Derwent Publication accession No. 95–080924, Eka Nobel AB: "Method for producing paper, cardboard and similar prods . . . ", SE,A,9301998, 941211, DW9511 (1995), No Month Available.

Derwent Publication accession No. 98–425471, Anonymous: "Aseptic packaging board sizing agents— . . . ", RD,A,411082, 980710,DW9836 (1998), No Month Available.

Eklund et al., *Paper Chemistry*, DT Paper Science Publications, Grankulla, Finland, pp. 214–215 (1991), No Month Available.

* cited by examiner

*Primary Examiner*—David Brunsman
(74) *Attorney, Agent, or Firm*—Birch, Stewart, Kolasch, & Birch, LLP

(57) ABSTRACT

A sizing composition and a method of sizing a cellulosic fiber material are disclosed. The sizing composition comprises an aqueous dispersion of a rosin material and a polyaluminium compound, and is characterised in that the polyaluminium compound is a polyaluminium phosphate sulphate compound. The polyaluminium phosphate sulphate compound should comprise at least 5% by weight, calculated as aluminium on the amount of rosin material in the composition. It is preferred that the sizing composition also comprises a synthetic sizing agent in addition to the rosin material. The dispersion preferably also includes a dispersing agent and has a dry content of at least 1% by weight. The sizing composition is used for the sizing of cellulosic fibre materials, such as paper, board or paper board by adding 0.01–5% by weight, calculated as dry sizing agent on dry cellulose fibers, of the sizing composition to the cellulosic fiber material, preferably to a cellulose stock for internal sizing of the cellulosic fiber material.

10 Claims, No Drawings

SIZING COMPOSITION AND A METHOD OF SIZING

This application is a Continuation of PCT International Application NO. PCT/SE99/00593 filed on Apr. 13, 1999, which designated the United States, and on which priority is claimed under 35 U.S.C. § 120, the entire contents of which are hereby incorporated by reference.

FIELD OF INVENTION

The present invention relates to a sizing composition comprising an aqueous dispersion of a rosin material and a polyaluminium compound, and to a method of sizing a cellulosic fibre material.

BACKGROUND

One of the main properties of paper, paperboard and similar products is hydrophobation or resistance to penetration by water and other liquids, such as lactic acid, hydrogen peroxides solutions, etc. Hydrophobation also plays an important role in printing properties, affecting the way inks are adsorbed on paper products. The two main methods for conferring hydrophobic properties to paper products are internal sizing, which gives a hydrophobic effect in the entire paper structure, surface sizing, more or less limited to the actual surface structure, and a combination of both methods. The most common hydrophobic agents in internal sizing are rosin, synthetic sizing agents, such as alkyl ketene dimers, isocyanates, acid anhydrides and carbamoyl chlorides and combinations of both components.

It has recently been experienced, however, that the initial liquid packaging board resistance to edge penetration by lactic acid and hot hydrogen peroxide-containing solutions achieved by traditional products or methods is not always maintained over time, which often means economic, converting and end-use problems. In addition, deficient ink jet properties, such as wicking, drying time, color appearance, etc, also imply serious end-use problems.

It has been shown that internal sizing with a cationic rosin size (CRS), such as those disclosed in ES-8900750, GB-2159153, EP-O-200002, U.S. Pat. No. 3,966,654 and U.S. Pat. No. 4,199,369, or with a conventional anionic rosin size (emulsion, paste or soap) gives the finished paper good resistance to penetration by water, but it also has some drawbacks, such as some limitations in pH and temperature, the difficulty to give the paper a good resistance to penetration by acid liquids or the need to be used in comparatively high amounts to give a satisfactory sizing effect. On the other hand, rosin dispersions are widely used and cannot in all circumstances be replaced by synthetic sizing agents; rosin dispersions give, for example, a good adhesion to yankee cylinders.

Synthetic sizing agents react with the cellulose to give an irreversible bond. Although these sizing agents generally lead to a very good sizing effect, both to water and other liquids, they do also have some disadvantages. For example, sizing must be carried out at neutral or slightly alkaline pH's (between 7 and 8.5) to be effective, there is a risk of hydrolysis in water and synthetic sizing agents cannot give the finished paper a good resistance to penetration by hot peroxides. Moreover, although synthetic sizing agents give good ink holdout and brighter colors, some other ink jet properties are relatively poor, such as wicking, drying time or color-to-color bleed.

It is known to combine rosin and some synthetic sizing agents, which allows to overcome some of the aforementioned disadvantages when they both are used alone. For example, EP-A-0074544 discloses a method of sizing using cationic dispersions which contain as dispersed phase particles of fortified rosin as well as particles of the synthetic sizing agent. EP-O-275851 discloses a method of sizing utilizing the above cationic and anionic dispersions which further contain a polyaluminium compound. DE-A1-41 03 169 discloses a sizing composition including a conventional sizing agent together with an aluminium phosphate that contains on the average 1.5–3 phosphor atoms per aluminium atom. EP-O-693589 discloses a method of sizing paper and similar cellulose products containing precipitated calcium carbonate as a filler using the above dispersions. In WO 96/35841 a watersoluble inorganic alkali metal salt is added to improve the stability of cationic dispersions of sizing agents based on rosin and cellulose reactive material. U.S. Pat. No. 4,522,686 discloses a sizing composition in the form of an aqueous dispersion containing a cellulose-reactive sizing agent, fortfied rosin and a water-soluble, nitrogen containing dispersing agent, the last two components forming the elements of a CRS. EP-A-0 292 975 discloses a method for use in producing liquid packaging board. However, in the above publications there is no suggestion that there is a particular problem caused by the decrease in the resistance to edge-penetration by hot hydrogen peroxide-containing solutions, namely the board is within specifications at the reel, but, upon ageing, this resistance decreases to a level where it then remains constant. There is no suggestion, either, that there is a particular problem caused by deficient ink jet properties, such as wicking, drying time or color-to-color bleed.

Moreover, dispersions of sizing agents can exhibit stability problems whose practical consequences are a markedly increased viscosity, agglomeration and phase separation, which may lead to depositions, difficulty in dosing and deteriorated sizing.

SUMMARY OF THE INVENTION

It is an object of the present invention to provide a sizing composition and a method of sizing a cellulosic fibre material that reduce or eliminate the above disclosed problems associated with the prior art, and more particularly to provide a sizing composition with enhanced stability and which gives improved long time resistance to edge penetration by lactic acid and hot hydrogen peroxide-containing solutions when the composition is used for sizing cellulosic fibre materials such as paper, board and paper board.

According to the invention it has been found that the above problems may be alleviated or eliminated and superior results achieved by using as a polyaluminium compound in the sizing composition a polyaluminium phosphate sulphate (PAPS) compound. It has been found that polyaluminiumphosphate sulphates present in the sizing dispersion strongly enhances its sizing effect as compared to non-phosphate containing polyaluminium salts.

Thus, according to one aspect the present invention provides a sizing composition comprising an aqueous dispersion of a rosin material and a polyaluminium compound, characterised in that the polyaluminium compound is a polyaluminium phosphate sulphate compound.

According to another aspect the present invention provides a method of sizing a cellosic fibre material, such as paper, board or paper board, characterised in that the above sizing composition is added to the cellulosic fibre material in an amount of 0.01–5% by weight, calculated as dry sizing agent on dry cellosic fibres.

The dispersions according to the invention have low tendency to agglomerate and separate on storage, showing very good shelf life.

It has also been found that such dispersions used in the process for making a board for a container for consumable liquids gives its cut edges a high resistance to penetration by hot hydrogen peroxide and lactic acid and avoids the loss of such resistance upon ageing. Moreover, sizing with the dispersions described in the present invention give very good ink-jet properties such as wicking, drying time, color-to-color bleed or color appearance, overcoming the problems caused by a poor response. These surprising effects are even more unexpected since it was found that the use of a synthetic sizing agent, such as AKD, rosin size and alum or, alternatively, the use of combinations of rosin and synthetic sizing agents, such as those described in the aforementioned patents, did not give the same sizing effects. The polyaluminium compounds of the present invention differ substantially from the prior art polyaluminium compounds, especially the polyaluminium sulphates described for example in WO 94/01619 and EP-62015.

These and other advantages and characterising features of the present invention will appear from the following specification and the appended claims.

DETAILED DESCRIPTION OF THE INVENTION

The superior results achieved with the polyaluminium compound of the present invention are beleived to be due to the incorporation of phosphate into the polyaluminium compound. In addition to the phospate ions the compound also includes sulphate ions and hydroxide ions as counter ions. Sometimes chloride ions may occur in minor amounts as a contamination.

Preferably, the polyaluminium phosphate sulphate compound of the present invention has the following general formula (I):

$$[Al(H_3PO_4)^x(OH)_y(SO_4)_{(3-y)/2}]_n \quad (I)$$

where $0{,}01 \leqq x \leqq 0{,}5$ and $0{,}03 \leqq y \leqq 2{,}5$ and n is an integer $\geqq 1$.

Preferably, x lies in the range of 0,02–0,3 and y lies in the range of 0,2–2,2.

The charge of the ortho-phosphate depends on the pH. The pH of polyaluminium salt solutions depends on the basicity, aluminium concentration and temperature of the solution. At room temperature most polyaluminium salts have a pH in the range of 0–4. The $pK_{al}$ of phosphoric acid is 2,15. In strongly basic or in diluted polyaluminium phosphate salt solutions some of the phosphate may be present as $H_2PO_4^-$. For the sake of simplicity the presence of phosphate in the above formula (I) is shown as phosphoric acid. The factors x and y in the formula hold irrespectively in which form the phosphate is present.

Depending on the method used when producing the polyaluminium phosphate sulphate it may also contain a neutral salt such as $Na^+$, $K^+$, $NH_4^+$, $Ca^{2+}$or $Mg^{2+}$ sulphate, chloride or formate.

The polyaluminium phosphate sulphate(PAPS)compound according to the invention can be prepared by dissolving aluminium sulphate, adding aluminium metal to the solution, refluxing the mixture and adding phosphoric acid to the mixture.

In the aqueous dispersion the polyaluminium phosphate sulphate compound is preferably present in an amount of at least 5% by weight, more preferably 20–60% by weight, calculated as aluminium on the amount of rosin material of the sizing composition.

The sizing agent in the dispersions according to the invention may comprise only rosin material or rosin material in combination with synthetic sizing agents.

The rosin material used in the dispersions according to the invention should have a high free rosin content. Rosin and rosin material herein otherwise refer to known types of rosin such as gum-, wood-, tall oil rosin and mixtures thereof. The rosin-based sizing agent can be selected from rosin, modified rosin, fortified rosin and mixtures thereof. Modified rosin is rosin that has been modified in a known manner, such as for example disproportionated rosin, hydrogenated rosin, polymerized rosin, esterified rosin, etc. The rosin material is preferably fortified rosin, i.e. a Diels Alder adduct obtained in a known manner by the reaction between rosin, optionally modified as above, and an α, β-unsaturated carbonyl compound, i.e. fumaric acid, maleic acid or their anhydrides or half esters, acrylic acid and methacrylic acid. In combinations according to the present invention the degree of fortification of the rosin material can reach up to about 15 per cent by weight of adducted α, β-unsaturated carbonyl compound, based on the total weight of the fortified rosin.

The amount of rosin component present in the rosin-based sizing agent is preferably in the range of from about 25 to about 95% by weight based on the total amount of rosin-based sizing agent. Preferably the rosin component is present in an amount from about 15% to 50% by weight.

In addition to the rosin material the sizing composition of the present invention preferably also comprises a synthetic sizing agent. Synthetic sizing agents are well known in the art and preferably includes at least one member selected from the group consisting of ketene dimers, acid anhydrides, organic isocyanates, and carbamoyl chlorides.

When the sizing composition comprises both a rosin material and a synthetic sizing agent the rosin material comprises up to 95% by weight, preferably 10–95% by weight, based on the total weight of the rosin material and the synthetic sizing agent.

The synthetic sizing agents in the mixed particles in the present dispersions are preferably selected from the group consisting of ketene dimers, acid anhydrides, organic isocyanates, carbamoyl chlorides and miztures thereof. Ketene dimers (AKD) are preferred. They have the general formula:

AKD

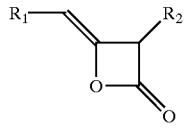

wherein both $R_1$ and $R_2$ represent hydrocarbon groups having about 6 to about 30 carbon atoms, usually being alkyl groups having 12 to 20 carbon atoms, such as hexadecyl and octadecyl groups.

The aqueous dispersion of the sizing composition of the invention preferably has a dry content of at least 1% by weight, more preferably at least 5% by weight. The upper limit of the dry content depends on the type of sizing agent used and usually is about 50% by weight.

In the dispersions of the present invention the dispersed phase consists of particles of a mixture of rosin and synthetic sizing agent whereby the mixture contains from 10 to 95% by weight of rosin. As the particles contain a homogeneous mixture of the active sizing agents the weight ratio in each particle in the dispersion will thus be in this range.

Dispersions of mixed particles may be prepared without using any dispersing agent. Alternatively and preferably, dispersions may be prepared using one or several dispersing agents selected from anionic, cationic or non-ionic dispersing agents. The amount of dispersing agent should be sufficient to give the dispersions the desired storage stability. The upper limit is not critical, but normally it is sufficient to use no more than 5% by weight, preferably 0.1–5% by weight.

Cationic dispersing agents can for example be selected from nitrogen containing dispersing agents such as quaternary ammonium compounds and salts of tertiary amines. Protective colloids or retention agents, such as catinonic starch, casein, cellulose derivatives, guar gum, polyvinylalchol, polyacrylamide, polyethyleneimine, polyamine, polyamidoamine, polyethyleneamine or polyacrylate can also be included in the dispersions. Anionic surfactants can be selected from alkyl sulphates, alkyl sulphonates, alkylarene sulphonates, i.e. sodium lauryl sulphate or sodium lignosuphonate. Nonionic dispersing agents can for example be alkoxylated alcohols, alkylphenols and fatty acids, partial fatty acid esters of polyvalent alcohols with 2 to 8 carbon atoms, or anhydro derivatives of these, and alkolylated derivatives of these.

The dispersion according to the invention can contain dispersed particles of rosin-based sizing agent and ispersed particles of synthetic sizing agents, or dispersed particles containing a mixture of rosin based sizing agent and synthetic sizing agents, or a combination of the mentioned dispersed particles. Dispersions containing discrete particles of rosin-based sizing agent and synthetic sizing agents can be prepared by mixing a preformed dispersion of rosin-based sizing agent with a preformed dispersion of synthetic sizing agents.

Aqueous cationic dispersions of rosin-based sizing agents are commercially available or can be prepared in a per se conventional manner, e.g. by homogenizing the active substance in water in the presence of a dispersing agent using high shear forces and high temperatures so that fine particles are obtained as the dispersed phase. The active substance which is homogenized is a rosin component. The active substance is dispersed in water in the presence of a dispersing agent under satisfactory agitation. The warm dispersed phase is then cooled and mixed with the polyaluminium phosphate sulphate compound. The final dispersion is homogenized.

Aqueous dispersions or emulsions of synthetic sizing agents are known in the art and commercially available and such dispersions can be prepared in a per se conventional manner, e.g. by mixing the synthetic sizing agent with an aqueous solution of a dispersing agent or emulsifier and passing the mixture through a homogenizer.

The novel dispersions of this invention can be prepared by mixing of a rosin-based dispersion, and a synthetic sizing agent dispersion. Modification of the above procedures are also suitable and within the skill of the art to which the invention pertains.

The present dispersions are particularly suitable for sizing of paper, board, paper board and similar cellulose fibre products. The dispersions can be used for internal and surface sizing. The dispersions are preferably used for internal sizing and are added in a conventional manner to a cellulose stock and conventionally used chemicals at paper production, such as drainage and/or retention agents, aluminium compounds, fillers, wet strength resins, dyes, optical brightening agents, etc, can of course be used with the present dispersions. The dispersions can be used in an amount corresponding to 0.01 to 5% by weight of sizing agent, counted as dry on dry cellulose fibres, suitably in an amount corresponding to 0.025 to 1% by weight of sizing agent.

The invention is further illustrated in the following examples, which, however, are not intended to limit the same. Parts and percentages relate to parts by weight and per cent by weight, respectively, unless otherwise stated.

In the examples below Examples 1–3 relate to the preparing of aluminium phosphate sulphate compounds used in the present invention; Example 4 is a comparative example relating to the preparation of an aluminium phosphate compound according to the abovementioned DE-A1-41 03 169; Example 5 relates to the preparation of a sizing composition containing a rosin material; Example 6 relates to a sizing composition of Example 5 further including the inventive aluminium phosphate sulphate compound of Example 1; Example 7 relates to a sizing composition of Example 5 further including the aluminium phosphate of comparative Example 4; Example 8 relates to the inventive sizing composition of Example 6 further including a synthetic sizing agent; and Example 9 relates to the sizing composition of comparative Example 7 further including a synthetic sizing agent; and Example 10 relates to the use of the sizing compositions of Examples 6–9 for the sizing of paper.

EXAMPLE 1

100 grams of a granulated aluminium sulphate with an aluminium concentration of 9,1% was dissolved in 190 grams of water in a flask with round bottom. 3,4 grams of aluminium powder was added and the temperature was increased to about 95° C. The mixture was kept at this temperature under reflux for about 3 hours. 10,6 grams of a 85% phosphoric acid was added and the mixture was allowed to cool to room temperature. The solution was analysed for Al, P and S and found to consist of $[Al(H_3PO_4)_{0,2}(OH)_{0,8}(SO_4)_{1,1}]_n$ with an aluminium concentration of 4,0%.

EXAMPLE 2

100 grams of a granulated aluminium sulphate with an aluminium concentration of 9,1% was dissolved in 201,3 grams of water in a flask with round bottom. 10,6 grams of aluminium metal granules was added and the temperature of the mixture was increased to about 95° C. under agitation. The mixture was kept at this temperature under reflux for about 5 hours. 16,5 grams of a 85% phosphoric acid was added and the solution was cooled to room temperature. The material was filtered and the solution was analysed for Al, P and S.

It contained 6,0% Al and its composition was $[Al(H_3PO_4)_{0,2}(OH)_{1,6}(SO_4)_{0,7}]_n$.

EXAMPLE 3

100 grams of a granulated aluminium sulphate with an aluminium concentration of 9,1% was dissolved in 218 grams of water. 10,6 grams of aluminium metal particles were added and the temperature of the mixture was increased to about 95° C. under agitation. The mixture was kept at this temperature under reflux and agitation for about 5 hours. 4,16 grams of a 85% phosphoric acid and 151 grams of water was added. The product was filtered through a Whatman GF/C filter and analysed for Al, P and S. It contained 4,0% Al and its composition was $[Al(H_3PO_4)_{0,05}(OH)_{1,6}(SO_4)\ (_{0,7}]_n$.

EXAMPLE 4 (COMPARATIVE)

207,5 g of 85% $H_3PO_4$ and 55 g of aluminium hydrate (65% $Al_2O_3$) were heated at 110° C. under agitation. Once the solution was clear, the temperature was lowered up to 80° C. and 162 g of water were added. It contained 4,4% Al and a molar ratio (P/Al) of 2,6.

EXAMPLE 5

100 parts of wood rosin and 15 parts of maleic anhydride were heated at 200° C. during 2 h under agitation. The temperature was lowered to 160–170° C. and 5 parts of 20% sodium hydroxide was added under slow agitation. Finally, 50 parts of 10% caseine were added under vigorous agitation. The final concentration was adjusted with water and the resulting emulsion was allowed to cool.

EXAMPLE 6

50 parts of emulsion according to Example 5 were mixed under vigorous agitation with 50 parts of solution of polyaluminium phosphate sulphate according to Example 1. The resulting emulsion was stirred for 1 hour.

EXAMPLE 7 (COMPARATIVE)

50 parts of emulsion according to Example 5 were mixed under vigorous agitation with 50 parts of solution of polyaluminium phosphate sulphate according to Example 4. The resulting emulsion was stirred for 1 hour.

EXAMPLE 8

50 parts of emulsion according to Example 6 were mixed with 50 parts of an AKD emulsion containing 15% AKD wax at 40° C. with vigorous agitation. The final sizing emulsion was stirred for 1 additional hour.

EXAMPLE 9 (COMPARATIVE)

50 parts of emulsion according to Example 7 were mixed with 50 parts of an AKD emulsion containing 15% AKD wax at 40° C. with vigorous agitation. The final sizing emulsion was stirred for 1 additional hour.

EXAMPLE 10

Paper sheets with a basis weight of 120 g/m$^2$ were prepared from a mixture of bleached softwood and hardwood (10:90 by weight) sulphate pulp, at pH values of 5–7,2, according to Tappi standard practice T205 sp-95 for laboratory scale. In Table I below are shown Cobb-values measured according to Tappi standard T 441 om-90. Sizing dispersions, prepared as 10% solutions, were added to the thick stock just prior to dilution at the sheet former. No additional chemicals were added. Sizing level refers to kg of sizing agent per metric ton of dry cellulose fibers.

TABLE I

| Sizing | Sizing level (%) | | | | $Cobb_{60}$ |
|---|---|---|---|---|---|
| dispersion | Emulsion | AKD | Rosin | Pulp pH | (g/m$^2$) |
| Example 6 | 5 | | 0.06 | 7.2 | 50 |
| Example 6 | 10 | | 0.12 | " | 35 |
| Example 7 | 5 | | 0.06 | " | 82 |
| Example 7 | 10 | | 0.12 | " | 61 |
| Example 8 | 5 | 0.038 | 0.03 | " | 25 |
| Example 8 | 10 | 0.075 | 0.06 | " | 20 |
| Example 9 | 5 | 0.038 | 0.03 | " | 36 |

TABLE I-continued

| Sizing | Sizing level (%) | | | | $Cobb_{60}$ |
|---|---|---|---|---|---|
| dispersion | Emulsion | AKD | Rosin | Pulp pH | (g/m$^2$) |
| Example 9 | 10 | 0.075 | 0.06 | " | 29 |
| Example 6 | 5 | | 0.06 | 5.0 | 41 |
| Example 6 | 10 | | 0.12 | " | 24 |
| Example 7 | 5 | | 0.06 | " | 47 |
| Example 7 | 10 | | 0.12 | " | 29 |
| Example 8 | 5 | 0.038 | 0.03 | " | 22 |
| Example 8 | 10 | 0.075 | 0.06 | " | 19 |
| Example 9 | 5 | 0.038 | 0.03 | " | 28 |
| Example 9 | 10 | 0.075 | 0.06 | | 23 |

A better performance of emulsions produced from the polyaluminium phosphate sulphates described in this invention is clearly noticed, especially at neutral pH.

What is claimed is:

1. A sizing composition comprising an aqueous dispersion of a rosin material and a polyaluminium compound, characterised in that the polyaluminium compound is a polyaluminium phosphate sulphate compound.

2. A sizing composition according to claim 1, wherein the polyaluminium phosphate sulphate compound has the general formula (I):

$$[Al(H_3PO_4)_x(OH)_y(SO_4)_{(3-y)/2}]_n \quad (I)$$

were $0.01 \leqq x \leqq 0.5$ and $0.03 \leqq y \leqq 2.5$ and n is an integer $\geqq 1$.

3. A sizing composition according to claim 1, wherein the polyaluminium phosphate sulphate compound comprises at least 5% by weight, calculated as aluminium on the amount of rosin material in the composition.

4. A sizing composition according to claim 1, wherein the composition, in addition to the rosin material comprises a synthetic sizing agent.

5. A sizing composition according to claim 4, wherein the synthetic sizing agent comprises a component selected from the group consisting of ketene diners, acid anhydrides, organic isocyanates, carbamoyl chlorides, and mixtures thereof.

6. A sizing composition according to claim 4, wherein the rosin material comprises 10–95% by weight, based on the rosin material and the synthetic sizing agent of the composition.

7. A sizing composition according to claim 1, wherein the dispersion has a dry content of at least 1% by weight.

8. A sizing composition according to claim 1, which includes a dispersing agent.

9. A method of sizing a cellulosic fibre material, such as paper, board or paper board, characterised in that the sizing composition according to any one of claims 1–8 is added to the cellulosic fibre material in an amount of 0.01–5% by weight, calculated as dry sizing agent on dry cellulosic fibers.

10. A method according to claim 9, wherein the sizing composition is added to the cellulosic fibre material in the form of a cellulose stock for internal sizing of the cellulosic fibre material.

* * * * *